US005411677A

United States Patent [19]

Pickering et al.

[11] Patent Number: 5,411,677

[45] Date of Patent: May 2, 1995

[54] METHOD AND COMPOSITION FOR PREVENTING COPPER CORROSION

[75] Inventors: Howard W. Pickering, State College, Pa.; Yongchun Wu, Hoboken, N.J.

[73] Assignee: The Penn State Research Foundation, University Park, Pa.

[21] Appl. No.: 52,875

[22] Filed: Apr. 26, 1993

[51] Int. Cl.[6] ..... C23F 11/14

[52] U.S. Cl. ..... 252/389.1; 252/387; 252/394; 106/14.44; 422/12; 422/16

[58] Field of Search ..... 252/394, 387, 389.62; 422/16, 12; 106/14.17, 14.44

[56] References Cited

U.S. PATENT DOCUMENTS

| | | | |
|---|---|---|---|
| 2,559,580 | 7/1951 | Alexander | 252/387 |
| 2,567,156 | 9/1951 | Malowan | 423/269 |
| 2,941,953 | 6/1960 | Hatch | 252/389.62 |
| 3,653,931 | 4/1972 | Borchert et al. | 106/3 |
| 3,791,803 | 2/1974 | Andress, Jr. et al. | 252/51.5 R |
| 3,816,322 | 6/1974 | Griffin et al. | 252/147 |
| 3,985,503 | 10/1976 | O'Neal, Jr. | 422/7 |
| 4,143,119 | 3/1979 | Asperger et al. | 423/226 |
| 4,640,713 | 2/1987 | Harris | 106/3 |
| 4,744,950 | 5/1988 | Hollander | 422/16 |
| 4,851,149 | 7/1989 | Carandang | 252/147 |
| 5,128,065 | 7/1992 | Hollander | 252/394 |
| 5,156,769 | 10/1992 | Cha et al. | 252/394 |

FOREIGN PATENT DOCUMENTS 2330340 1/1974 Germany .

*Primary Examiner*—Robert L. Stoll
*Assistant Examiner*—Valerie Fee
*Attorney, Agent, or Firm*—Thomas J. Monahan

[57] ABSTRACT

A corrosion inhibitor composition and a method for employing the same to prevent corrosion of copper and copper containing metals in contact are disclosed. Protection is afforded thereto by contacting the metal surface with the medium containing sufficient amount of benzotriazole/its derivatives and halogen, preferentially iodide or bromide ions. The inhibitor has particular utility in protecting metal surfaces which are subject to corrosion in aggressive aqueous systems.

16 Claims, 7 Drawing Sheets

METHOD AND COMPOSITION FOR PREVENTING COPPER CORROSION

BACKGROUND OF THE INVENTION

Copper and copper base alloys are widely used in industry due to their good heat conductivity and corrosion resistance, such as pipelines of cooling systems and heat exchangers, but copper and its alloys usually suffer severe corrosion in acidic media. Using inhibitors to prevent copper corrosion is the most economical anti-corrosion method for many applications of copper. Benzotriazole (BTA, $C_6H_4N_3H$) and its derivatives (e.g., 1-methyl-benzotriazole, BTAM, tolyltriazole, also referred to as TTA or carboxybenzo-triazole CBT) are so far the best inhibitors in preventing the corrosion of copper and its alloys in industry. The patents pertinent to the BTA copper corrosion inhibition include U.S. Pat. Nos. 3,653,931; 3,791,803; 3,985,503; 4,744,950; 5,128,065; and 5,156,769. However, the inhibition efficiency of BTA and its derivatives drops dramatically in acid solutions, although the film formed in acid solutions is thicker than those formed in neutral and alkaline media. For example, the low inhibition efficiency of BTA/its derivatives in acid solution causes a problem in pickling (using acid solutions to dissolve the scales); too much copper is dissolved thus reducing service life. The low efficiency of commercially available inhibitors in acid also means that inhibitors are not available for preventing scale formation (e.g., calcium carbonate) in cooling systems which are nominally neutral but become acidic because of absorption of carbon dioxide and more corrosive toward copper. Similarly, Cu can be corroded by acidic rain, cooling, sea and potable water. In the case of slightly acidic potable waters, the copper levels in the water can become unacceptably high for consumption at levels well below those that cause degradation of the copper pipes. Therefore, efforts are underway to develop better inhibitors in these acidic environments.

Since the good inhibiting nature of BTA is known to be due to formation of a stable polymer film that occurs on copper surfaces in neutral and alkaline solution, efforts are underway to develop similar dense, thick films on copper in acidic media. BTA by itself is unsatisfactory in this regard.

Although potassium iodide (KI) has been used as an additive to improve the inhibition efficiency of some other organic inhibitors in preventing corrosion of irons and steels due to a synergistic effect, e.g., used with trans-cinnamaldehyde and alkynols to decrease the corrosion of steel in 20% HCl solution, it or other iodide compounds have not been adopted in copper corrosion prevention. Patents describing the corrosion inhibiting feature of potassium iodide, or iodide ion, include U.S. Pat. Nos. 2,559,580; 2,567,156; 3,816,322; 4,143,119; 4,640,713; and 4,851,149.

Although there were no suggestions that a combination of iodide compounds with BTA might increase the inhibiting property of the latter, we decided to explore such an approach and observed quite unexpectedly that such combination possessed superior anti-corrosion properties. This unexpected result led to further studies of the mechanism of the protective properties of the said combination of BTA and iodide ions. As mentioned earlier, the iodide ions are effective additives to some other organic inhibitors of corrosion of iron and steel. When used with trans-cinnamaldehyde and alkynols to decrease the corrosion of steel in 20% HCl solution, it is reported to do so by electrostatic attraction rather than film formation. Consequently, iodide compounds have not been adopted in copper corrosion prevention. The conventional explanation of the electrostatic attraction is that an attractive force exists between adsorbed anions on the metal and the organic cations, thus the adsorption of the organic cations on the metal surface is improved.

Our work has shown, however, that in the case of copper, the effects of the iodide ions on improving the inhibition efficiency of BTA/its derivatives is more complicated than simply an electrostatic force effect; the iodide ions actually form a polymer-like, dense, thick (400nm) film with copper and BTA/its derivatives, thereby possibly explaining the selective nature of BTA+KI (or other iodide compounds) for specifically functioning as a good inhibitor of copper, but not steels, etc. This multi-compound inhibitor provides a strong synergistic inhibition of copper corrosion in a wide variety of environments.

Most of the art that relates to the inhibition of corrosion of copper-bearing metals in aqueous systems requires the constant presence of the inhibitor in the aqueous medium. Only one of the examples cited, U.S. Pat. No. 4,744,950, addresses the method of inhibiting corrosion by formation of a stable and durable inhibiting film which does not require maintaining a level of inhibitor in the aqueous medium. The present invention provides an alternative to the protection of the copper bearing metals by formation of a protective film on its surface, which does not require maintenance of a level of inhibitor in the aqueous medium. The measured thickness of the formed film (400 nm) which is much greater than the reported thickness of the BTA film (5 nm) suggests a superior property of the composition and a method of using it as described in this invention.

SUMMARY OF THE INVENTION

In accordance with the present invention, a new inhibitor of high efficiency for preventing copper corrosion and methods related thereto, is presented. In the preferred embodiment this inhibitor comprises a mixtures of iodide, e.g. added as KI or NaI, and BTA and its derivatives and was developed for preventing copper corrosion in various acidic environments, such as acid and acidic media (e.g., acid rain, cooling, sea and potable water). Weight loss tests and electrochemical techniques demonstrate that a strong synergistic inhibition exists when BTA/its derivatives are used with iodide/-bromide to prevent the corrosion of copper. The synergistic effect is largely due to forming an inhibitor film of a new complex, CuIBTA. This new complex film greatly depresses the anodic (corrosion) reaction.

OBJECTS OF THE INVENTION

An object of this invention is to develop a new inhibitor for preventing copper corrosion.

It is also an object of the invention to provide a method of preparation of the new inhibitor.

Another object of this invention is to provide a method of application of the aforementioned inhibitor.

These and other objects and advantages of this invention over prior art and a better understanding of its use will become readily apparent from the following description and are particularly delineated in the appended claims.

DETAILED DESCRIPTION OF THE INVENTION

Figure 1:
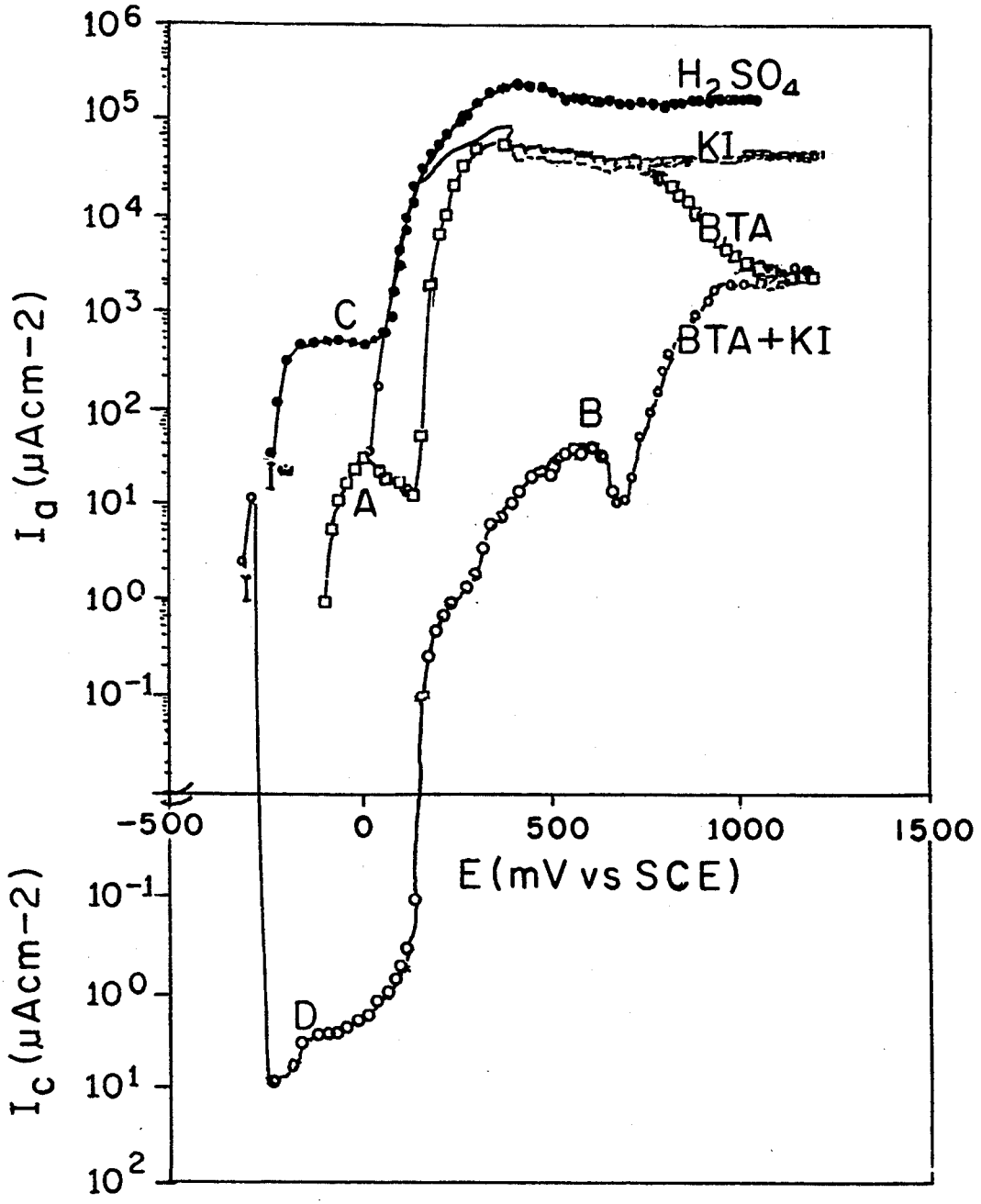
FIG. 1. Anodic polarization curves for copper in 0.5M $H_2SO_4$ ($H_2SO_4$), in 0.5M $H_2SO_4$−0.01M KI (KI), in 0.5M $H_2SO_4$−0.02M BTA (BTA), and in 0.5M $H_2SO_4$−0.01M BTA−0.01M KI (BTA+KI).

The present invention describes the new inhibitor for preventing copper corrosion. During the course of detailed studies involving investigation of corrosion prevention, we developed an unusually efficient inhibitor based on a synergistic inhibition effect due to formation of the inhibitor film of a new complex between BTA and iodide ions, CuIBTA.

A detailed embodiment of the present invention is herein described. However, it is understood that the disclosed preferred embodiment is merely illustrative of the invention which may be embodied in various forms. Accordingly, specific details disclosed herein are not to be interpreted as limiting, but merely as a support for the invention as claimed and as appropriate representation for teaching one skilled in the art to variously employ the present invention in any appropriate embodiment.

The examples described below provide supporting evidence for the proposed conclusions that the combination of iodide with BTA/its derivatives (e.g., TFA) significantly decreases the corrosion rate of copper in various acidic environments, such as acid and acidified potable, fresh, and sea water, and as such will prevent corrosion of copper in acidic solutions in contrast to commercially available inhibitors which have a low efficiency in acids. Even in neutral solutions in which BTA is a good inhibitor by itself, some improvement is observed when iodide is added. The electrochemical studies and weight loss tests indicate a synergistic effect of BTA/derivatives and iodide on inhibiting copper corrosion by the formation of an I containing BTA film on the copper surface. The stability of the inhibitor films on the copper surface is also improved by adding iodide to BTA/its derivatives, as shown in experiments in which the performance of the preformed film on the copper was determined during exposure to corrosives which did not contain the inhibitor. The high inhibition efficiency and stability of films of I containing BTA/its derivatives shows great potential in preventing corrosion in acids and acidified and neutral media, including solutions used during commercial pickling processes, fresh and sea water used in cooling systems and heat exchangers, and potable water.

The mechanism of the synergistic effect is not simply an electrostatic force between adsorbed I anions and organic cations but the formation of a thick inhibitor film of the Cu-I-BTA/its derivatives complex. This film greatly depresses the anodic copper dissolution reaction.

Experimental Procedure

The experimental methods employed in the present invention are based on the following procedures.

Commercial purity (99.9%) copper was used as the samples in the experiments. The samples were mechanically polished sequentially down to 0.05 mm dia. alumina powder. After the polishing, the samples were degreased in acetone, washed with distilled water and dried in flowing compressed dry nitrogen gas. Reagent grade chemicals and double distilled water were used to prepare the electrolytes: oxygenated <pH1 solutions: 0.5M $H_2SO_4$, 0.5M $H_2SO_4$−0.01M KT, 0.5M $H_2SO_4$−0.01M (or 0.02M or 0.1M BTA) BTA, and 0.5M $H_2SO_4$−0.01M BTA−0.01M KI (or NaI or KBr); pH3 solutions: 0.1M $Na_2SO_4$−x $H_2SO_4$, 0.1M $Na_2SO_4$−x $H_2SO_4$−0.01M BTA (or TTA or CBT), 0.1M $Na_2SO_4$−x $H_2SO_4$−0.01M BTA (or TTA or CBT)−0.01M KI, where x means adding enough $H_2SO_4$ to make a pH3 solution; near neutral solutions: 3.5% NaCl, 3.5% NaCl−0.05M BTA, and 3.5% NaCl−0.05M BTA−0.01M KI, 0.1M $Na_2SO_4$, 0.1M $Na_2SO_4$+0.01M BTA, and 0.1M $Na_2SO_4$+0.01M BTA+0.01M KI. Some pH3 solutions were also made by adding $H_2SO_4$, KI and BTA or TTA to tap water. To prove that the synergistic effect exists when BTA and iodide are used together to prevent copper corrosion, 0.5M $H_2SO_4$−0.02M BTA, 0.5M $H_2SO_4$−0.1M BTA, and 0.5M $H_2SO_4$−0.01M KI were also used in measuring the polarization curves and polarization resistance, $R_p$.

An EG&G PAR 273 Potentiostat, a standard cell and samples with one $cm^2$ area exposed, and software packages M342C and 270, were used to obtain the polarization curves, corrosion current and polarization resistance (by the linear polarization method, ±10 mV), and cyclic voltammetry curves. The scan rate in the potentiodynamic experiments was 0.1 mV $s^{-1}$. A quartz microbalance was used to study the stability of the inhibitor films. A small amount of oxygen gas was introduced to the electrochemical cells in the polarization experiments, except in the weight-loss, quartz microbalance, and x-ray photoelectron spectroscopy (XPS) experiments where the cells were open to the laboratory atmosphere.

Example 1

Weight Loss and Average Corrosion Rate Test

The flat copper samples with 1 $cm^2$ area were exposed to the media in a container filled with solutions A, B or C after first weighing as in the description for Table 1 and kept immersed for a period of one month. After removal from the media and drying, the weights of the samples were again measured. The samples were returned to the respective containers and kept for an additional month and weighed again. From the weight loss (weight measured after immersion subtracted from weight measured before immersion), the average corrosion rate for each period was calculated as the weight loss times twice the Faraday constant divided by the product of the immersion time (one or two months), the copper surface area and the atomic weight of copper.

TABLE 1

Weight loss results (g) and calculated corrosion rates ($\mu A\ cm^{-2}$)

| solutions | Δ1 | Δ2 | $i_{1.corr.}$ | $i_{2.corr.}$ | $W_0$ | $W_1$ | $W_2$ |
|---|---|---|---|---|---|---|---|
| A | 0.0362 | 0.0691 | 21.06 | 40.20 | 0.9599 | 0.9237 | 0.8546 |
| B | 0.0066 | 0.0136 | 3.83 | 7.90 | 1.1069 | 1.1003 | 1.0867 |
| C | 0.0040 | 0.0082 | 2.30 | 4.77 | 0.9054 | 0.9014 | 0.8932 |

Notes:
A, 0.5M $H_2SO_4$
B, 0.5M $H_2SO_4$ + 0.01M BTA
C, 0.5M $H_2SO_4$ + 0.01M BTA + 0.01M KI
$\Delta 1 = W_1 - W_0$ and $\Delta 2 = W_2 - W_1$ where $W_0$, $W_1$ and $W_2$ are the original weight of the samples, the weight after one month in the solutions and after two months in the solutions, respectively. $i_{1,corr.}$ and $i_{2,corr.}$ are the corrosion currents calculated from Δ1 and Δ2, respectively.

The cells were open to the laboratory air.

Example 2

Polarization Resistance Measurement

The polarization resistance, $R_p$, was measured in-situ during the immersions of the copper specimens in the different solutions shown in Table 2 by the standard linear polarization method and the corrosion rate (as a function of time during each immersion period) was calculated for each $R_p$ value. An increase in polarization resistance corresponds to a decrease in corrosion rate. The obtained values are shown in Table 2.

TABLE 2

Polarization resistance and corrosion current by the linear polarization method

| solutions | R p ($k\Omega\ cm^2$) | $i_{corr.}$ ($\mu A\ cm^{-2}$) |
|---|---|---|
| 0.5M $H_2SO_4$ (A) | 0.5628 | 43.57 |
| 0.5M $H_2SO_4$ + 0.01M KI | 0.3068 | 67.29 |
| 0.5M $H_2SO_4$ + 0.01M BTA (B) | 1.605 | 17.07 |
| 0.5M $H_2SO_4$ + 0.02M BTA | 3.880 | 14.61 |
| 0.5M $H_2SO_4$ + 0.1M BTA | 5.310 | 13.7 |
| 0.5M $H_2SO_4$ +0.01M BTA + 0.01M KI(C) | 10.68 | 10.50 |

Note:
Oxygen was introduced into the cell during the experiments.

Tables 1 and 2 give the results of the weight loss tests and average corrosion rates of copper from the weight loss data and by the linear polarization method in the different solutions. The data in Table 2 also show that KI added to 0.5M $H_2SO_4$ by itself increases the corrosion rate of copper over that of the 0.5M $H_2SO_4$ solution, whereas the addition of BTA by itself to sulfuric acid decreases the corrosion rate. However, increasing amounts of BTA do not have a proportionally larger inhibition efficiency, i.e., there seems to be a saturation concentration above which BTA increases the inhibition efficiency very slightly. This known trend is also indicated in the data in Table 2. It is very interesting to note that the corrosion rate of copper is smallest in the solution containing both BTA and KI (BTA+KI solution), as shown in Tables 1 and 2. NaI showed a similar effect as KI. Actually, using both BTA and KI in the sulfuric acid solution decreases the corrosion rate more than using either BTA or KI alone, indicating that BTA and iodide ion have a synergistic effect to prevent copper corrosion. KBr showed also an inhibiting effect but less so then KI. It can be envisioned that other halogens can provide a similar synergistic effect.

Example 3

Polarization Measurements

The flat copper samples with 1 $cm^2$ area were exposed to the media of pH ranging from <1 to 7 i.e., ranging in pH from strongly acid to neutral, in a container. Using a power supply the potential applied to the copper/solution interface was increased in the positive direction corresponding to an increasing driving force for copper dissolution, and the rate of copper dissolution was recorded as the measured current, $I_a$, flowing in the circuit. The resulting curves are referred to as polarization curves.

Figure 2:
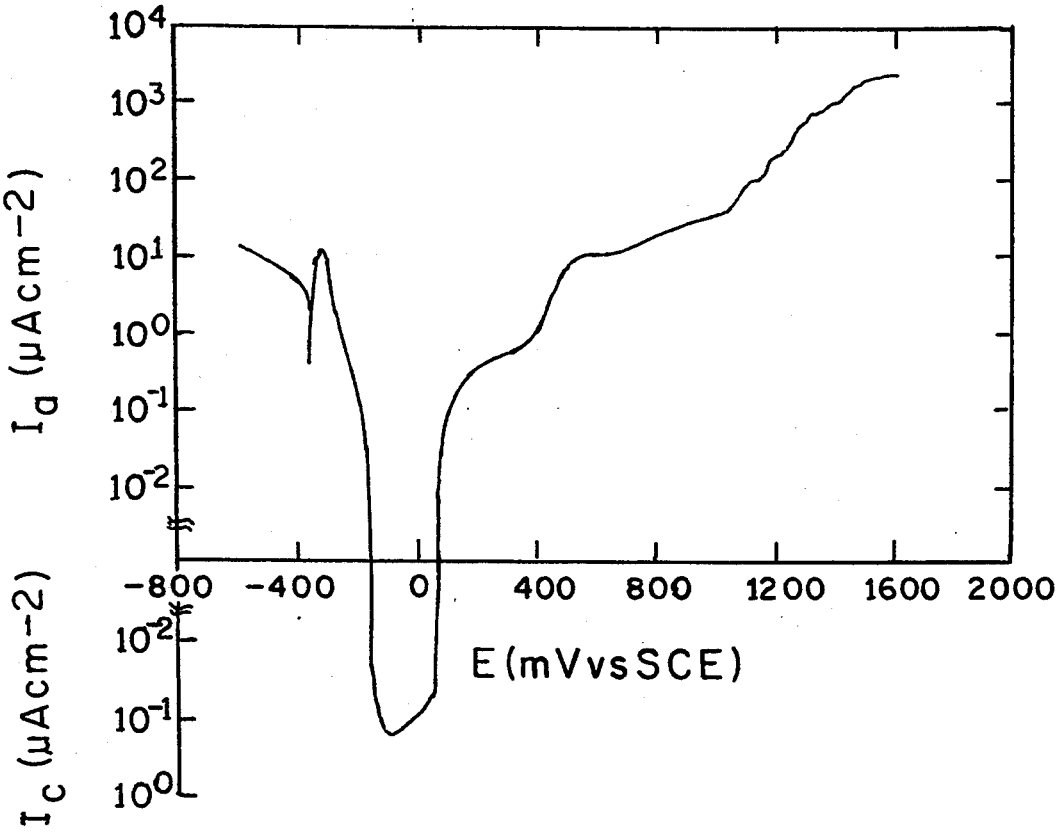
FIG. 2. Polarization curve of Cu in the 0.01M BTA+0.01M KI inhibited pH3 tap water solution.
Figure 3:
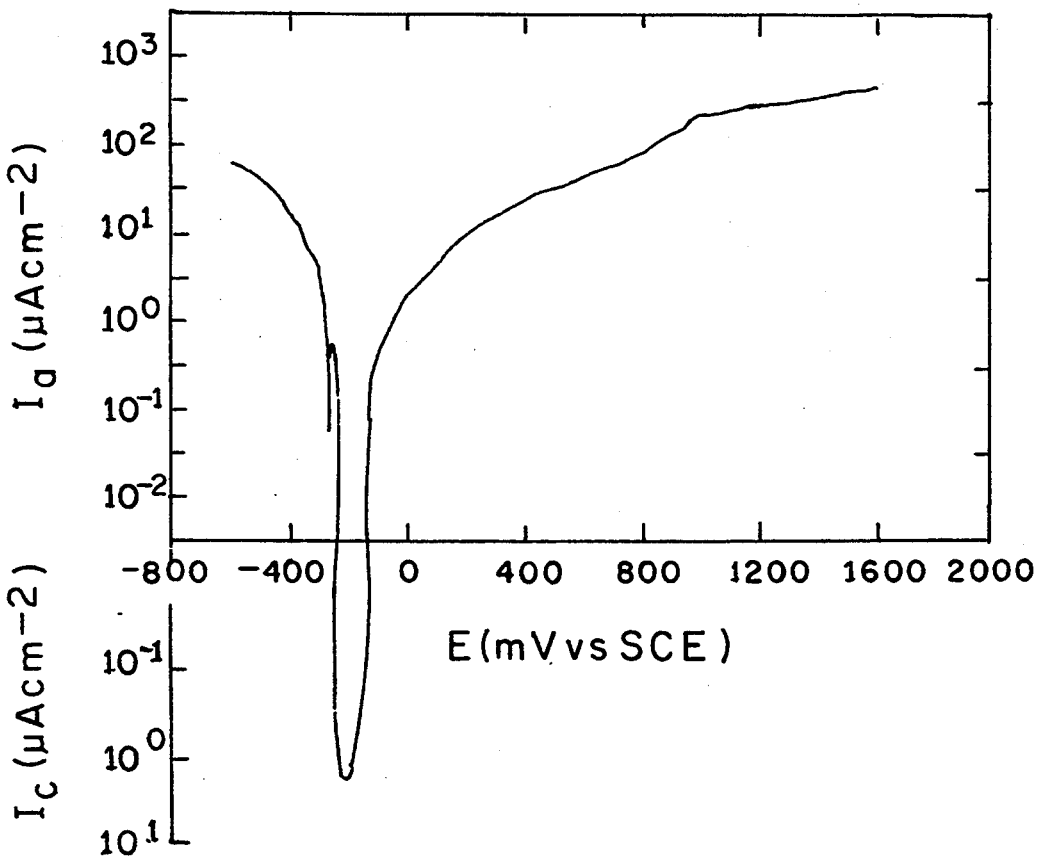
FIG. 3. Polarization curve of Cu in the 0.01M TTA+0.01M KI inhibited pH3 tap water solution.

FIGS. 1 to 3 are the measured polarization curves for different solutions at different acid strengths. FIG. 1 is for the strongly acid pH<1 solutions. In the upper section of FIG. 1, the current, $I_a$, is a measure of the copper dissolution rate and is seen to be much lower for the BTA+KI solution than the other solutions consistent with the data in Tables 1 and 2. In fact, the copper dissolution rate is so low for the BTA+KI solution that the measured current in the lower potential region (−250 to 150 mV in FIG. 1) is cathodic (lower section) as a result of the small cathodic currents of the reduction reactions, oxygen and/or hydrogen reduction. Thus, the addition of both 0.01M BTA and 0.01M KI to the solution dramatically depresses the copper dissolution rate compared to that for copper in 0.5M $H_2SO_4$−0.01M BTA, especially in the low potential region (up to 4 orders of magnitude below 600 mV vs SCE). The BTA curve shows much higher copper dissolution rates with only some depression of the rate at potentials more positive than the peak A potential before again rising steeply with increasing potential. Peak A in FIG. 1 (BTA solution) is known from our work and others (R. Alkire and A. Cangellari, J. Electrochem. Soc., 136, 913, 1989) to be due to the formation of an inhibitor film. Studies of the BTA film have revealed that the degree of the polymerization of the CuBTA film has a more profound effect on inhibiting copper corrosion than the thickness of the inhibitor film (Brusic, et al. J. Electrochem. Soc., 138, 2253, 1991).

Similarly, peak I in the BTA+KI solution (FIG. 1) is the formation of the inhibitor film. It is known that CuI-organic ligand complexes usually have a polymeric structure. This polymeric structure of Cu(IBTA) film may explain the high inhibition effect when the inhibitor film is still thin at the beginning of the film formation, i.e., the total current becomes cathodic at potentials more noble (positive) than the potential of the film formation (I) (FIG. 1). Our XPS results also support this Cu-iodide-organic polymeric structure. Note that peak 1 forms at a lower potential than peak A in the BTA solution, so that the potential range of protective film stability in the BTA+KI solution is larger, being extended in both directions compared to the BTA solution. Peak B in the BTA+KI solution represents a further increase in protective nature of the film. Thus, the addition of KI appears to cause a remarkable downward shift of the polarization curve for copper dissolution in the noble direction. It is obvious, by comparing the curves in FIG. 1, that the polarization curve of copper in the solution having both BTA and KI is very different from those of copper in the solutions having only BTA or KI, and they do not have a superimposed relationship. This again shows that BTA and KI have a synergistic effect in inhibiting the corrosion of copper in the sulfuric acid. Therefore, the inhibitor 0.01M BTA+0.01M KI prevents copper corrosion in a very wide range of potential for this very acidic condition with a much higher efficiency than BTA by itself, and thus can be used in widely different oxidizing and reducing environments.

FIGS. 2 and 3 show the copper dissolution polarization curves for pH3. Again, the addition of iodide to the BTA had a remarkable effect in these tests. FIGS. 2 and 3 show the polarization curves in the BTA+KI and TTA+KI inhibited pH3 solutions. Cathodic current is also observed over a potential range more positive than the first anodic peak, similar to FIG. 1, indicating a strong inhibition efficiency. Comparing FIGS. 2 and 3, the inhibiting efficiency of the BTA+KI inhibitor appears to be somewhat better than that of the TTA+KI inhibitor in this pH3 solution. In addition, even in neutral solutions (NaCl or $Na_2SO_4$) for which BTA by itself is already a good inhibitor, some improvement was noted when iodide was added.

Example 4

Quartz Microbalance Measurements

Figure 4:
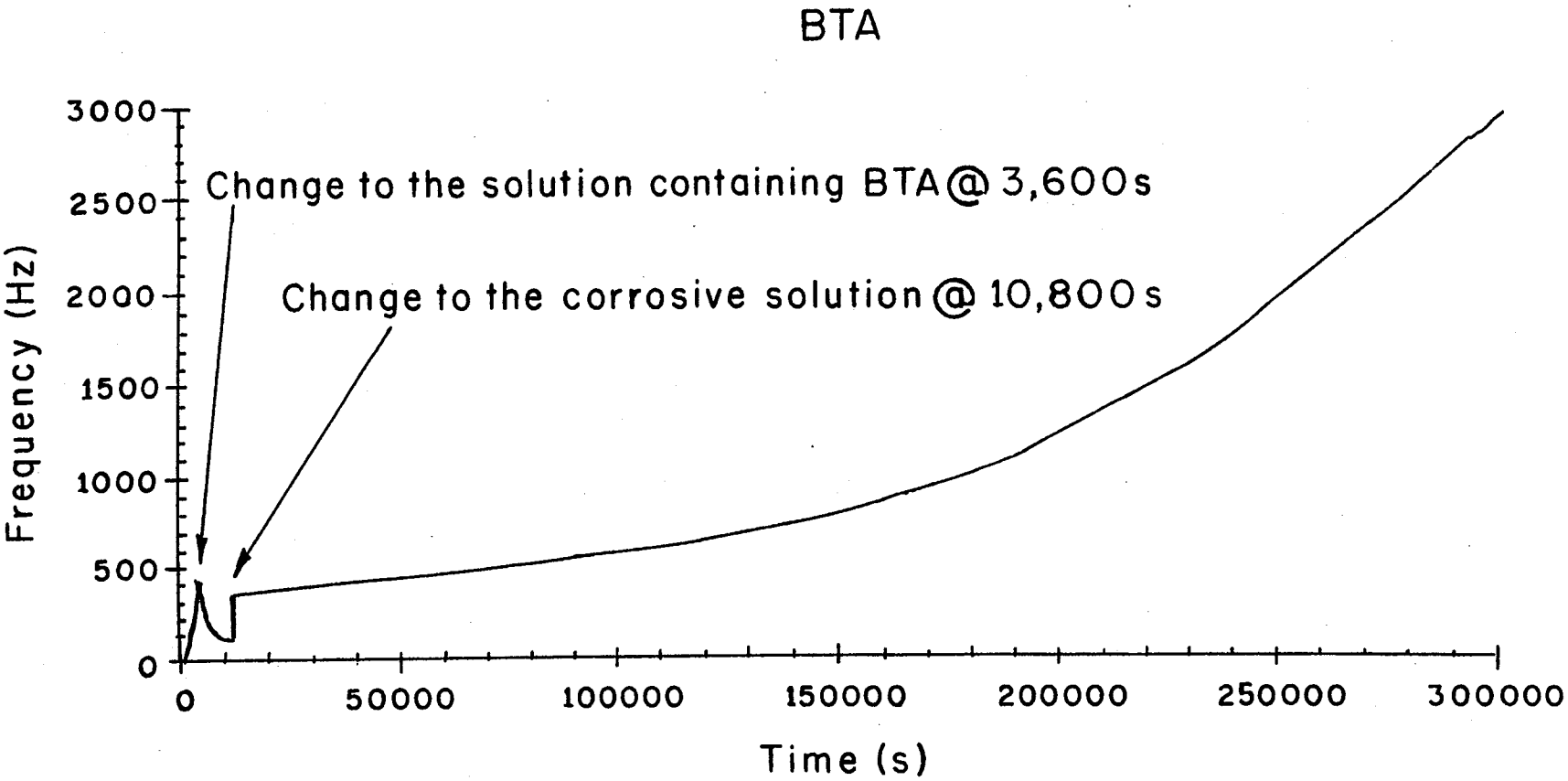
FIG. 4. Frequency-time relationship of the quartz microbalance for Cu in the BTA inhibited pH3 $Na_2SO_4$ solution.
Figure 5:
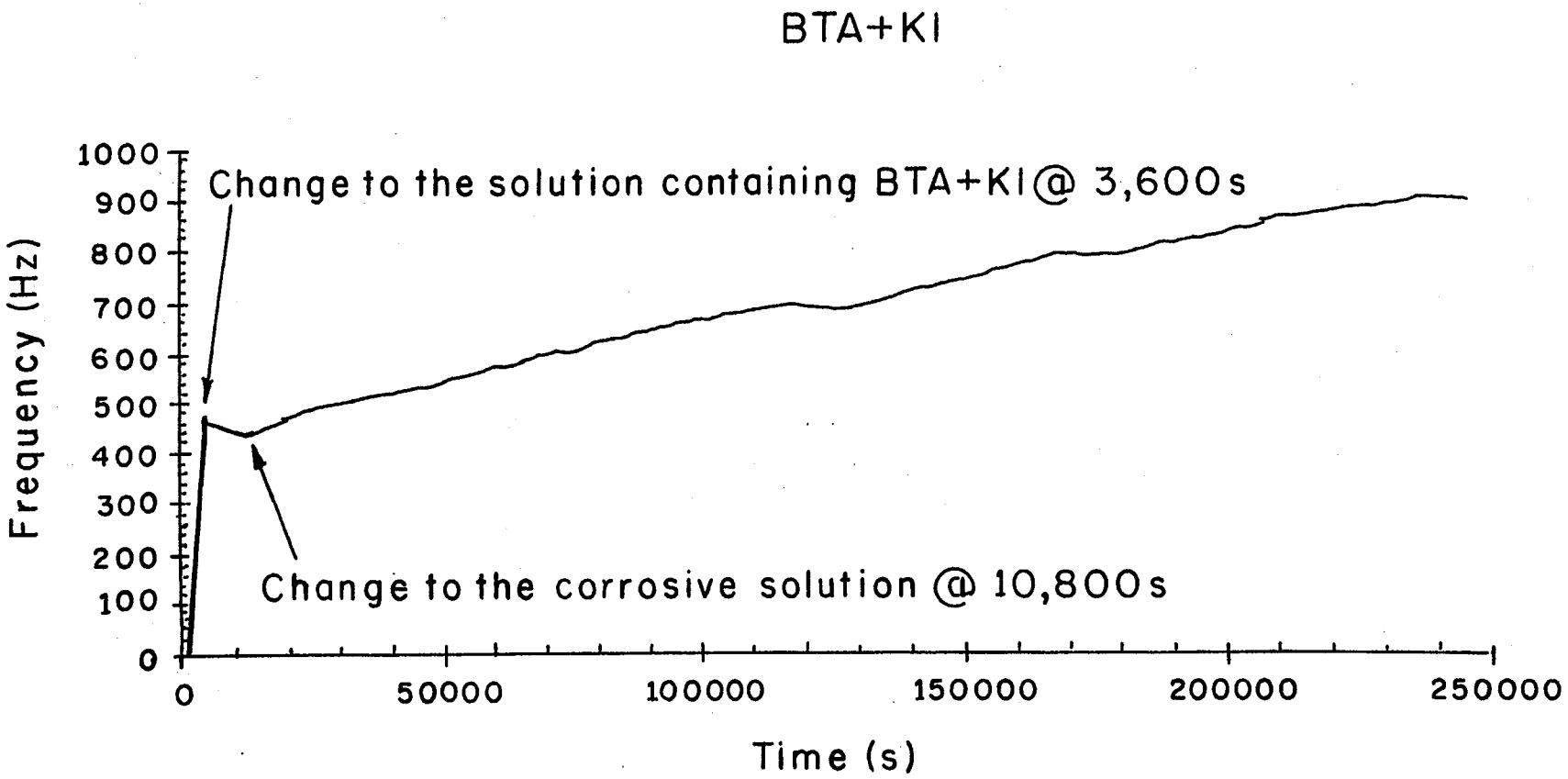
FIG. 5. Frequency-time relationship of the quartz microbalance for Cu in the BTA+KI inhibited pH3 $Na_2SO_4$ solution.
Figure 6:
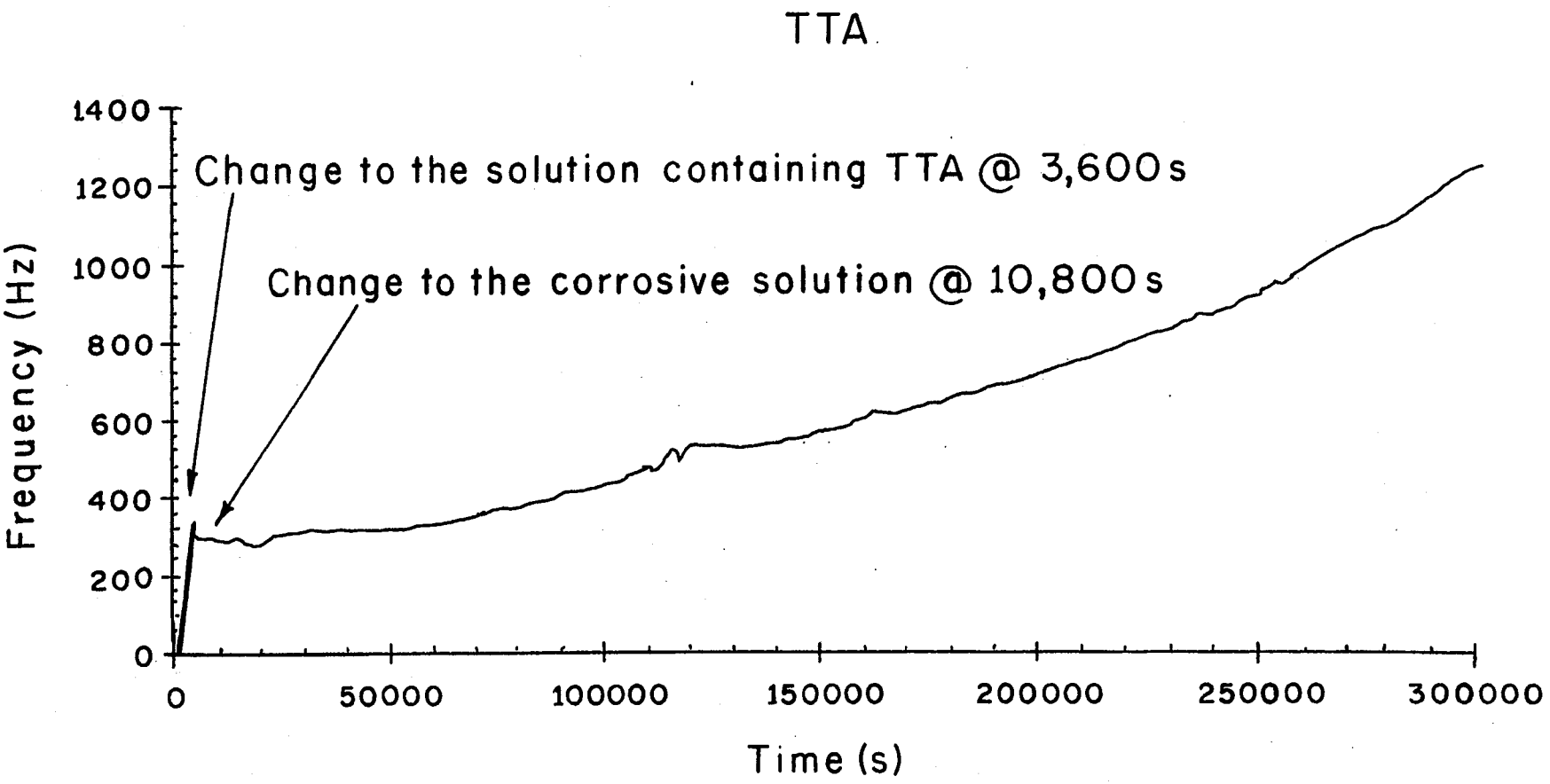
FIG. 6. Frequency-time relationship of the quartz microbalance for Cu in the TTA inhibited pH3 $Na_2SO_4$ solution.
Figure 7:
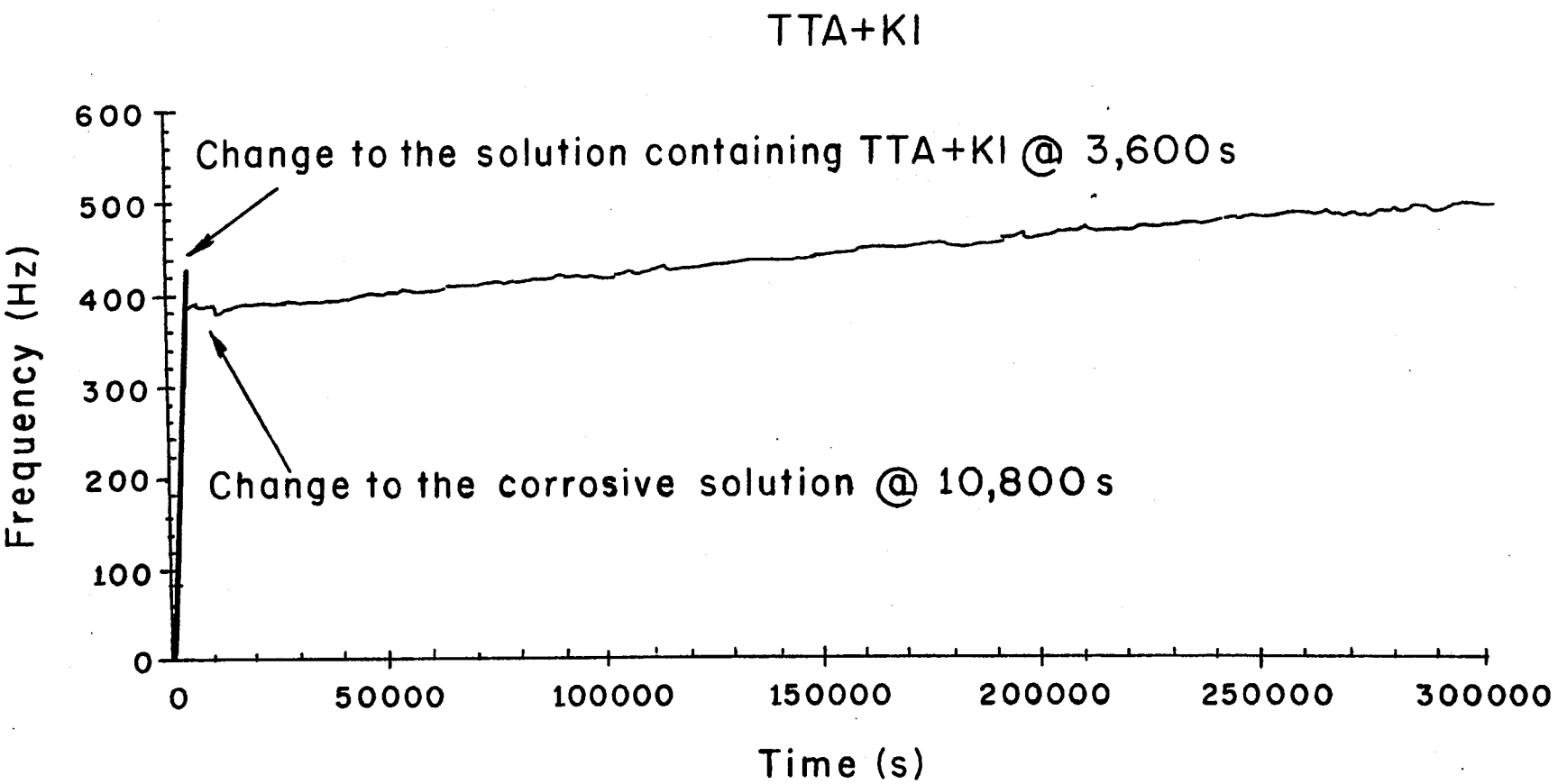
FIG. 7. Frequency-time relationship of the quartz microbalance for Cu in the TTA+KI inhibited pH3 $Na_2SO_4$ solution.

Quartz microbalance measurements were also carried out to study not only the efficiency of the new inhibitors but also the stability of the inhibitor films on the copper surface, stability being a measure of the durability of the film after the inhibitor has been removed from the aqueous phase. FIGS. 4 to 7 show the stability of different inhibitor films following removal of the inhibitor from the corrosive pH3 solution. An increase of the frequency means the sample has lost mass, so the faster the increase the higher the corrosion rate. Conversely, the slower the increase of the frequency in FIGS. 4 to 7, the lower the corrosion rate and the more stable the previously formed inhibitor film on the copper surface. Comparing FIGS. 4 and 5, the increase of the frequency of the previously formed BTA+KI inhibitor film is smaller than that for the previously formed BTA inhibitor film, indicating the BTA+KI inhibitor film is more stable. A similar phenomenon was observed for TTA and TTA+KI inhibitor films (comparing FIGS. 6 and 7). FIGS. 4 and 6 also show that the TTA inhibitor film is more stable than the BTA film. By comparison of FIGS. 4 to 7, it can be seen that the most stable inhibitor film in pH3 solution is that formed in the TTA+KI inhibited solution. In situations where the inhibitor would not be added to the aqueous phase during service, e.g., potable water, stability of the (preformed) inhibitor film on the copper surface is extremely important for protection against corrosion in the initial service period when the natural protective film develops.

Beside Benzotriazole (BTA) and tolyltriazole (TTA), carboxybenzotriazole (CBT) was tested and proved to be very effective in corrosion inhibition. Other derivatives of BTA may be used in preparation of the inhibitor disclosed herein.

In the preferred embodiment of this invention, the preparation of the corrosion inhibitor may involve adding (in either powder or liquid form, with or without mixing, mixed together or separately) the BTA/its derivatives and a compound supplying iodide or bromide ions or a compound which upon dissolving in the media forms the above said ionic species or supplying the two main ingredients to water or aqueous medium at the concentration ranging from 0.0001M to the upper concentration limited by their solubility, and in molar ratio based on molar concentration ranging from 1:100 to 100:1.

Inhibition of corrosion in a copper or copper base alloy can be achieved by supplying BTA/its derivatives and iodide (or bromide, or other halogen) ions into the media in contact with the copper or its alloys in proper concentration (ranging up to the solubility limits). To our best knowledge, the corrosion protection is achieved by the formation of the protective polymer-like film. Therefore, corrosion prevention can be envisioned by the pretreatment of copper and its alloys by formation of the said polymer film prior to the exposure to the corrosion media. Another technique would involve providing the essential ingredients to the media in contact with existing copper and its alloy systems. The recommended final concentration of BTA/its derivatives and of KI will depend on the strength of the corrosive media, including pH and nature and concentration of oxidants, e.g., in some cases 0.01M BTA/0.01M KI may be adequate but much higher and lower concentrations and different ratios of BTA and KI may also be prescribed.

Because of the long lasting and durable nature of the protective film, the application of the said anti-corrosion protective composition may be carded out in many ways. It can be used as a preliminary protective agent before the metal surface is exposed to the aggressive medium, it can be used on an intermittent basis and, obviously, continuous addition of the materials to form the said composition is also a viable means of usage.

Thus is described our invention and the manner and process of preparing it and using it in such full, clear, concise, and exact terms so as to enable any person skilled in art to which it pertains, or with which it pertains, or which is most nearly connected, to make and use the same.

What is claimed is:

1. A corrosion inhibition composition for metal which comprises:

a) at least one compound selected from the group consisting of heterocyclic compounds known as triazoles;

b) at least one compound selected from the group consisting of compounds providing in aqueous solution iodide ions and compounds providing in aqueous solution bromide ions; and c) an aqueous medium wherein the compounds a) and b) are present in said aqueous medium c) at concentrations sufficient for the purpose of forming on the surface of the metal in contact with said inhibition composition a corrosion inhibiting film.

2. The composition of claim 1, wherein the ratio of a):b) ranges from 100:1 to 1:100 in molar terms.

3. The composition of claim 1 wherein the molar ratio of compound a) and b) is about 1:1.

4. The composition of claim 1, wherein a) and b) are present at a concentration of at least about 0.0001 molar.

5. The composition of claim 1 wherein a) is BTA, TTA, or CBT.

6. The composition of claim 1 wherein b) is selected from the group consisting of KI, NaI, KBr, and NaBr.

7. The composition of claim 1 wherein the said metal is copper or alloys thereof.

8. A method of inhibiting the corrosion of a metal in contact with an aqueous medium comprising formation of an protective film on the surface of said metal by exposing the metallic surface to the composition of claim 1.

9. The method of claim 8, wherein the exposure of the metallic surface to the composition of claim 1 is provided in one of the following ways;

a) constant contact obtained by addition of said components of composition to the aqueous medium in contact with said metallic surface;

b) intermittently by periodical addition of said components of composition to the aqueous medium in contact with said metallic surface; and c) a one-time initial exposure of the metallic surface to the corrosion inhibition composition prior to the exposure of the metallic surface to the corrosive medium wherein the exposure of the metallic surface to the corrosion inhibition composition is for a period of time sufficient for formation of the said protective film.

10. A method according to claim 8 wherein the corrosion inhibitory composition ratio of triazole: iodide and triazole: bromide: ranges from 100:1 to 1:100 in molar terms.

11. A method according to claim 8 wherein the molar ratio of triazole iodide and triazole: bromide is 1:1.

12. A method according to claim 8 wherein triazole and iodide or bromide ions are present at a concentration of at least 0.0001 molar.

13. A method according to claim 8 wherein triazole is selected from the group consisting of BTA, TTA or CBT and the iodide ions providing compound is selected from the group KI and NaI, and the bromide ions providing compound is selected from the group consisting of KBr and NaBr.

14. A method according to claim 8 wherein the metal is copper or alloys thereof.

15. The corrosion inhibition composition of claim 1, wherein said triazoles comprise benzotriazole, C1 to C6 alkyl substituted benzotriazoles, and carboxybenzotriazole.

16. A corrosion inhibition composition of claim 15 wherein said alkyl substituted benzotriazoles comprise methyl- benzotriazoles, butylbenzotriazoles, and their isomers.

* * * * *

UNITED STATES PATENT AND TRADEMARK OFFICE

CERTIFICATE OF CORRECTION

PATENT NO. : 5,411,677
DATED : May 2, 1995
INVENTOR(S) : Pickering, H. W., et al.

It is certified that error appears in the above-indentified patent and that said Letters Patent is hereby corrected as shown below:

Column 1, line 4: insert --This invention was made with governmental support under Grant No. DMR-9300704 awarded by the National Science Foundation. The Government has certain rights in the invention.--

Signed and Sealed this

Eighteenth Day of February, 1997

*Attest:*

Bruce Lehman

BRUCE LEHMAN

*Attesting Officer*

*Commissioner of Patents and Trademarks*